US007331387B2

(12) United States Patent
McGarian et al.

(10) Patent No.: US 7,331,387 B2
(45) Date of Patent: Feb. 19, 2008

(54) DOWNHOLE WINDOW FINDER AND METHOD OF USING THE SAME

(75) Inventors: Bruce McGarian, Aberdeen (GB); Robert I. Chadwick, Portlethen (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/297,405

(22) PCT Filed: Apr. 24, 2001

(86) PCT No.: PCT/GB01/01823

§ 371 (c)(1),
(2), (4) Date: Mar. 5, 2003

(87) PCT Pub. No.: WO01/94745

PCT Pub. Date: Dec. 13, 2001

(65) Prior Publication Data

US 2003/0150612 A1 Aug. 14, 2003

(30) Foreign Application Priority Data

Jun. 9, 2000 (GB) ..... 0014146.5

(51) Int. Cl.
*E21B 23/12* (2006.01)
*E21B 7/08* (2006.01)

(52) U.S. Cl. ..... 166/255.3; 166/255.2; 166/117.6

(58) Field of Classification Search .. 166/255.1–255.3, 166/117.6, 50
See application file for complete search history.

(56) References Cited

U.S. PATENT DOCUMENTS

| | | | | |
|---|---|---|---|---|
| 2,766,010 | A * | 10/1956 | Hester | 166/117.6 |
| 5,293,945 | A | 3/1994 | Rosenhauch et al. | |
| 5,511,627 | A | 4/1996 | Anderson | |
| 5,785,133 | A * | 7/1998 | Murray et al. | 175/61 |
| 5,915,474 | A | 6/1999 | Buytaert et al. | |
| 6,012,516 | A * | 1/2000 | Brunet | 166/50 |
| 6,186,233 | B1 * | 2/2001 | Brunet | 166/298 |
| 6,209,644 | B1 * | 4/2001 | Brunet | 166/297 |

(Continued)

FOREIGN PATENT DOCUMENTS

| | | |
|---|---|---|
| EP | 0961008 | 12/1999 |

(Continued)

*Primary Examiner*—David Bagnell
*Assistant Examiner*—Shane Bomar
(74) *Attorney, Agent, or Firm*—Dykema Gossett PLLC

(57) ABSTRACT

The present invention relates to a downhole method and apparatus for locating a window in a wellbore casing and determining the depth and orientation of said window. Apparatus of the present invention comprises a body (4) and a window engaging member (6) mounted on said body (4) so as to be movable between a retracted position and an extended position. The engaging member (6) is adapted to project into a wellbore window when in the extended position during use and is further adapted to engage with a first position of said window in such a way that, when pressed against said window portion, the engaging member (6) tends to slide along wellbore edge defining said window portion so as to locate the engaging member (6) centrally in said window portion before preventing movement of the apparatus in the direction of pressing. The invention thereby allows the depth and orientation of a window in a wellbore to be determined.

8 Claims, 15 Drawing Sheets

U.S. PATENT DOCUMENTS

| | | | | |
|---|---|---|---|---|
| 6,244,340 | B1 * | 6/2001 | McGlothen et al. | 166/255.3 |
| 6,279,659 | B1 * | 8/2001 | Brunet | 166/313 |
| 6,283,208 | B1 * | 9/2001 | George et al. | 166/255.3 |
| 6,311,776 | B1 * | 11/2001 | Pringle et al. | 166/313 |
| 6,315,054 | B1 * | 11/2001 | Brunet | 166/387 |
| 6,568,480 | B2 * | 5/2003 | Dewey | 166/382 |
| 6,679,329 | B2 * | 1/2004 | Murray et al. | 166/313 |
| 2002/0023757 | A1 * | 2/2002 | George et al. | 166/380 |
| 2003/0034156 | A1 * | 2/2003 | Gondouin | 166/52 |

FOREIGN PATENT DOCUMENTS

| | | |
|---|---|---|
| GB | 2304760 | 3/1997 |
| GB | 2312696 | 11/1997 |
| WO | WO 01/25587 | 4/2001 |

* cited by examiner

DOWNHOLE WINDOW FINDER AND METHOD OF USING THE SAME

The present invention relates to a method and apparatus for use in downhole oil and gas drilling operations, particularly, but not exclusively, to a method and apparatus used in conjunction with a downhole single trip whipstock assembly, for locating a window in a well bore casing and determining the depth and orientation of said window.

It is well known in the oil and gas drilling industry to provide a main borehole with one or more lateral boreholes which branch from the main borehole and extend into one or more wells laterally displaced therefrom. The opening of a main borehole into a lateral borehole is commonly referred to as a "window". A window is typically formed with a whipstock assembly which is located at the required depth and orientated appropriately so as to laterally deflect a milling tool from the main borehole into the surrounding formation. Alternatively, pre-cut or pre-formed windows can also be used. These may be run in hole as part of the casing string and generally in conjunction with a profile sub located below the bottom of the window. The profile sub provides an appropriate means onto which equipment may be latched.

Once the lateral borehole has been drilled, a suitable lining and/or operational equipment may be run by using a whipstock or alternative means as a deflector. The deflection of equipment into the lateral may generally be achieved quite readily since the depth (i.e. the distance downhole) and orientation (i.e. the angular position about the well bore longitudinal axis) of the window are known and suitable deflecting equipment is already appropriately set. However, circumstances can arise when a main borehole is known to be provided with a lateral borehole, but the precise depth and orientation of the window is unclear. In this event, the proper positioning of downhole equipment (such as a whipstock) relative to the window is difficult to achieve. Consequential delays in running equipment into a lateral borehole can be highly inconvenient and extremely expensive.

It is an object of the present invention to provide a method and apparatus for permitting the determination of the location (i.e. depth) and orientation (i.e. angular position) of a window within a main borehole.

It is also an object of the present invention to provide a method and apparatus for permitting the determination of the location and orientation of a window in a rapid, convenient and inexpensive manner.

It is yet a further object of the present invention to provide a method and apparatus for permitting the determination of the location and orientation of a window in the same run as equipment is set in the main borehole relative to the window and equipment is run into the lateral borehole.

It is also an object of the present invention to provide a method and apparatus which is highly reliable and apparatus which requires minimal maintenance.

The present invention provides downhole apparatus for determining the depth and orientation of a window in a well bore, the apparatus comprising a body and a window engaging member mounted on said body so as to be movable between a retracted position and an extended position, the engaging member projecting a greater distance from said body when in the extended position than when in the retracted position, wherein the engaging member is adapted to project into a well bore window when in the extended position during use and is further adapted to engage with a first portion of said window in such a way that, when pressed against said window portion, the engaging member tends to slide along a well bore edge defining said window portion so as to locate the engaging member centrally in said window portion before preventing movement of the downhole apparatus in the direction of pressing, the engaging member being yet further adapted to engage a second portion of said window in such a way that, when pressed against said second window portion, the engaging member is moved towards the retracted position so as to permit movement of the downhole apparatus past said window.

Thus, the depth and orientation of a window may be determined with the apparatus of the present invention by moving the engaging member into the extended position and thereby projecting said member into the window. The apparatus may then be moved axially within the well bore (either by pushing an associated conveying string downhole or by pulling said conveying string uphole) so that the engaging member slides along a well bore edge defining the window. As the engaging member follows the edge towards, for example, an end of the window, the apparatus is rotated within the well bore so as to locate centrally on the window longitudinal axis (assuming the window is arranged parallel to the well bore axis rather than skewed relative thereto). The apparatus is thereby orientated relative to the window. Once the engaging member reaches the end of the window, further axial movement of the apparatus within the well bore is prevented and the depth of the window is thereby indicated.

Preferably, the engaging member is adapted to prevent movement of the downhole apparatus in the direction of pressing by means of a hooked portion provided on the engaging member. It is also preferable for the engaging member to be provided with a camming portion which permits an engagement with a window portion which moves the engaging member towards the retracted position. The engaging member preferably moves as a whole towards the extended position. Biasing means may also be provided to press the engaging member towards the extended position.

It is further preferable for means to be provided for releasably securing the engaging member in the retracted position. Said means may comprise a piston for moving guide rails of one of the engaging member and apparatus body into alignment with guide slots provided in the other of the engaging member and apparatus body. The piston may be movable by the application of static hydraulic pressure. The piston may also be secured to the apparatus body by means of a shear pin.

Also, the engaging member may be movable between retracted and extended positions by means of a cam provided on a piston movable relative to the engaging member. The engaging member may be provided with a cam for cooperating with the piston cam. The piston may be biased by biasing means to a first position in which the engaging member may locate in the retracted position. It is also preferable for the piston to be movable against the bias of the biasing means, under the application of dynamic hydraulic pressure, to a second position in which the engaging member is cammed to the extended position. The piston may be biased by means of a spring. The engaging member may also be biased towards the retracted position. The engaging member may be biased by means of a biasing member mounted on the apparatus body which is biased towards a cam surface of the engaging member so as to, in turn, bias the engaging member towards the retracted position. The biasing member may be biased towards said cam surface by means of a spring.

It may be further preferable for the engaging member to rotate between the retracted and extended positions about a pivot. Also, the apparatus may be provided with splines for fixing the angular position of the apparatus relative to further downhole apparatus.

The present invention also provides a method of determining the depth and orientation of a window in a well bore using the apparatus defined above, the method comprising the steps of running said apparatus into a well bore; projecting the engaging member into the window; and moving the apparatus within the well bore so that the engaging member locates centrally in a portion of the window before stopping said movement. The portion of window may be an uphole or downhole end of the window.

The method preferably comprises the further step of moving the apparatus so that the engaging member is pressed against a second portion of the window and thereby moved towards the retracted position so as to permit movement of said apparatus past said window. The method may comprise the yet further step of moving said apparatus past said window. Further downhole apparatus may then be located adjacent said window.

Embodiments of the present invention will now be described with reference to the accompanying drawings, in which.

Figure 1:
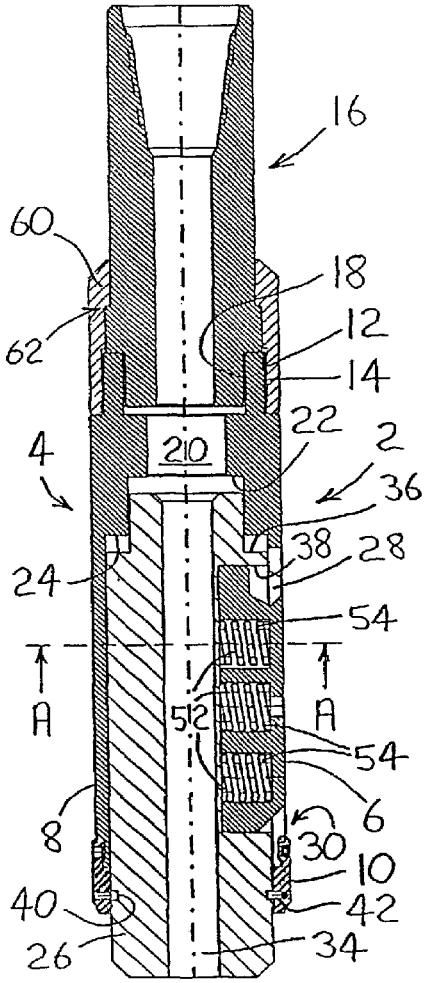
FIG. 1 is cross-sectional side view of a first embodiment of the present invention arranged in a retracted configuration.

A first embodiment of the present invention (i.e. a first window finder 2) is shown in FIGS. 1-7 of the accompanying drawings. The first window finder 2 is mechanically settable (as opposed to hydraulically settable) and is made up of a body 4, a window engaging member 6 (or dog) mounted in the body 4, and means for moving the window engaging member 6 relative to the body 4 between retracted and extended positions.

The body 4 incorporates an elongate cylindrical member 8 and a retaining nut 10. One end of the elongate cylindrical member 8 (the uphole end) is provided with a cylindrically shaped connecting portion 12, the external surface of which is provided with a screwthread 14 enabling connection of the first window finder 2 to a connecting sub 16. The internal surface of the connecting portion 12 is provided with splines 18 allowing a desired angular orientation of the first window finder 2 relative to the connecting sub 16 and any associated downhole equipment. The connection of the first window finder 2 to the connecting sub 16 will be described in greater detail below.

The elongate cylindrical member 8 is provided with a bore 20 longitudinally extending from the uphole end of said member 8 to a downhole end thereof. The diameter of the bore 20 increases at two locations downhole of the connecting portion 12 by virtue of two downhole facing internal shoulders 22, 24. In use, the portion of the bore 20 located below the upper internal shoulder 22 slidably receives a cylindrical piston 26 which is used to release the window engaging member 6 from a retracted position (see FIGS. 1-3).

Figure 2:
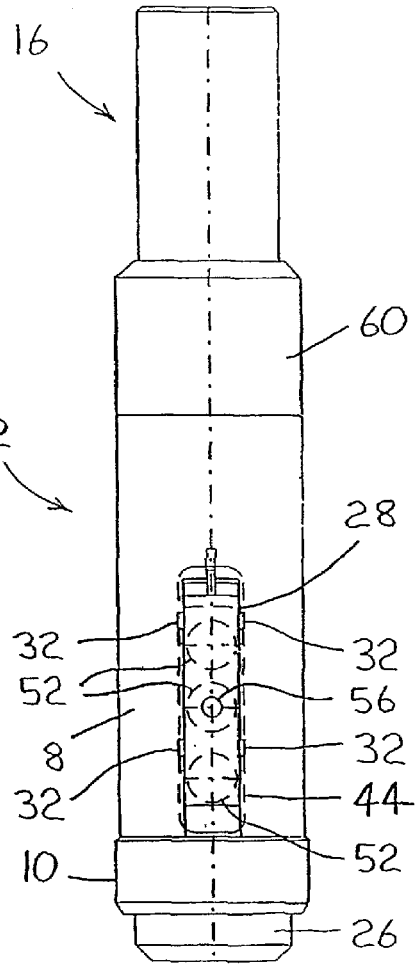
FIG. 2 is a plan view of the first embodiment arranged as shown in FIG. 1.
Figure 3:
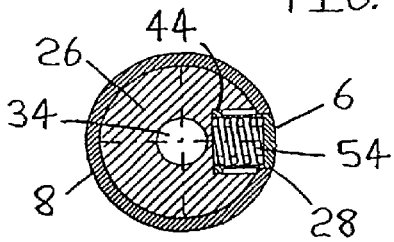
FIG. 3 is a cross-sectional end view taken along line A-A shown in FIG. 1.
Figure 6:
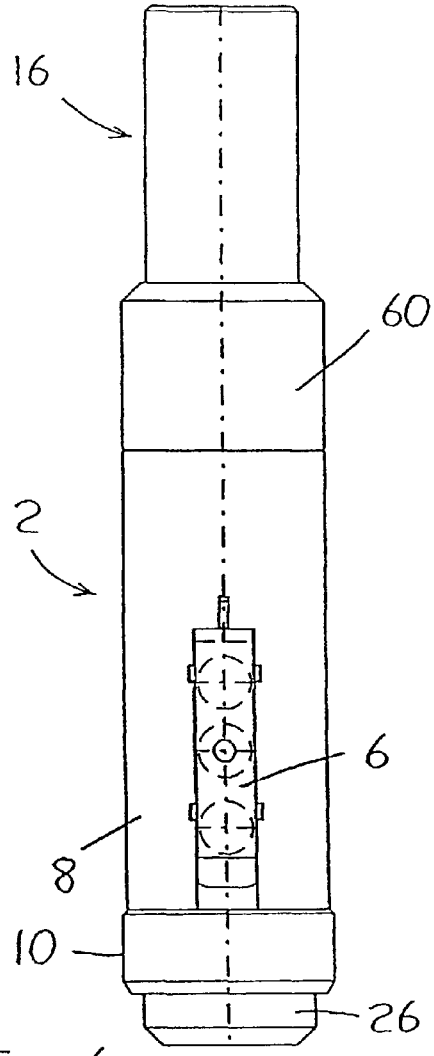
FIG. 6 is a plan view of the first embodiment arranged as shown in FIG. 5.
Figure 7:
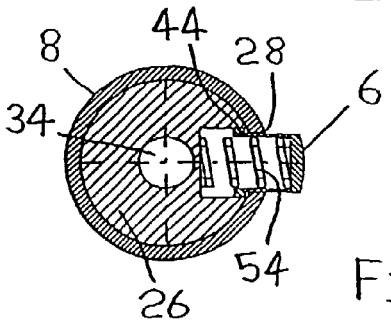
FIG. 7 is a cross-sectional end view taken along line B-B shown in FIG. 5.
Figure 8:
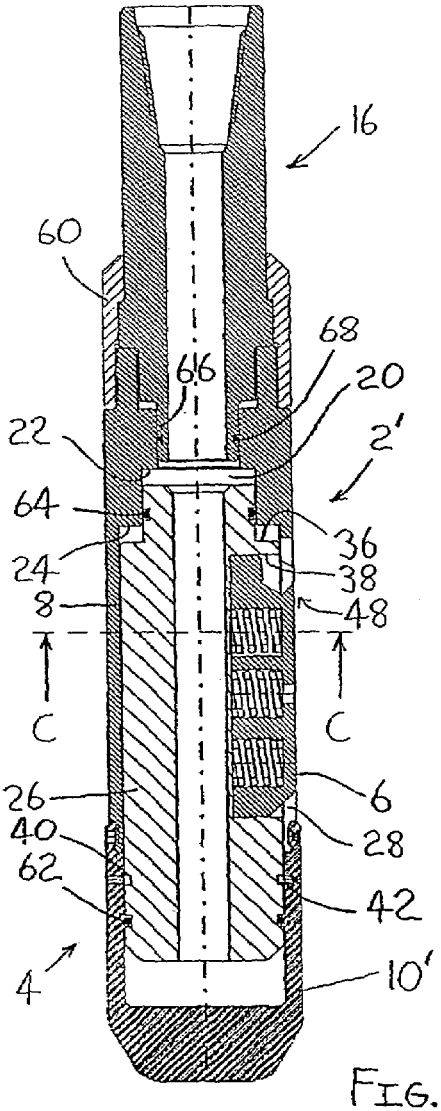
FIG. 8 is a cross-sectional side view of a second embodiment of the present invention arranged in a retracted configuration.
Figure 9:
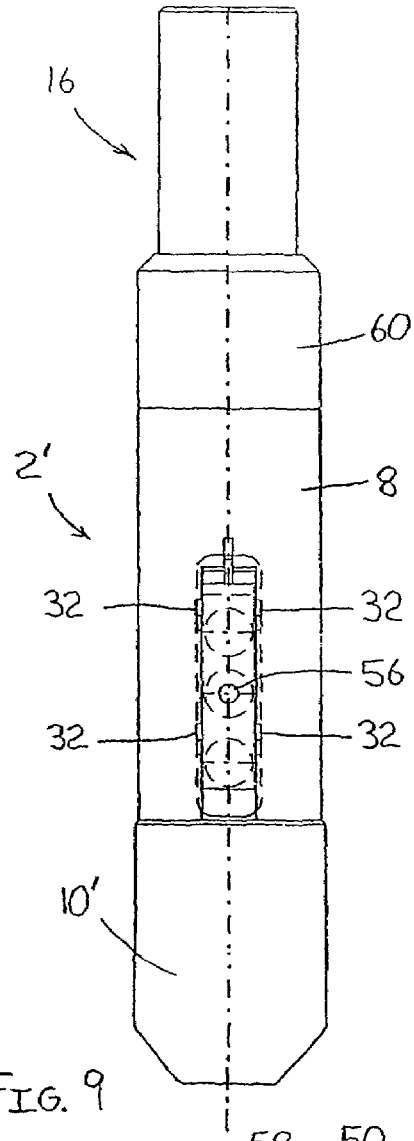
FIG. 9 is a plan view of the second embodiment arranged as shown in FIG. 8.
Figure 10:
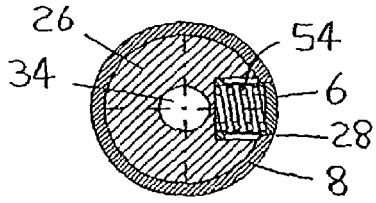
FIG. 10 is a cross-sectional end view taken along line C-C shown in FIG. 8.
Figure 11:
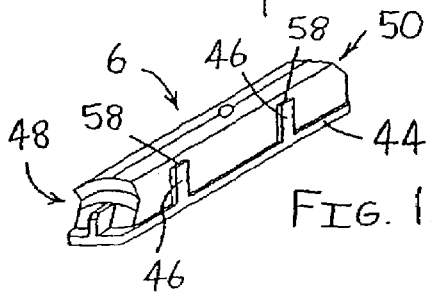
FIG. 11 is a perspective view of an engaging member of the second embodiment.
Figure 12:
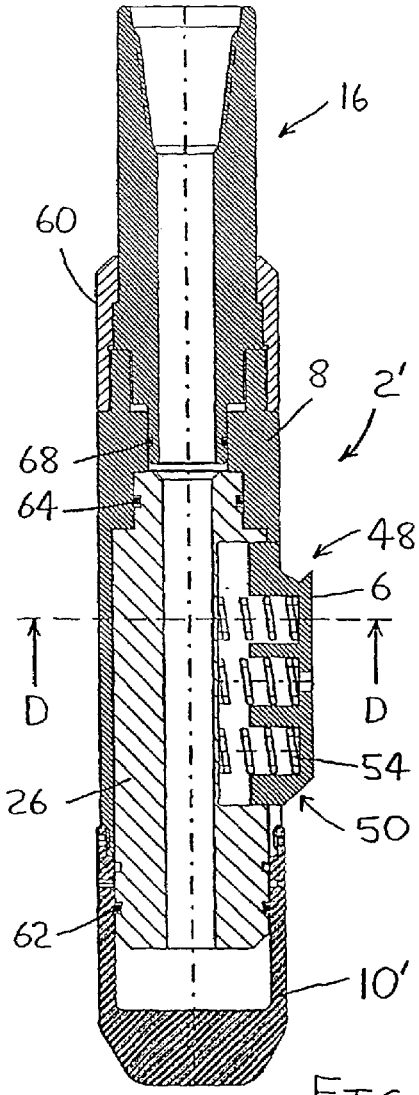
FIG. 12 is a cross-sectional side view of the second embodiment of the present invention arranged in an extended configuration.
Figure 13:
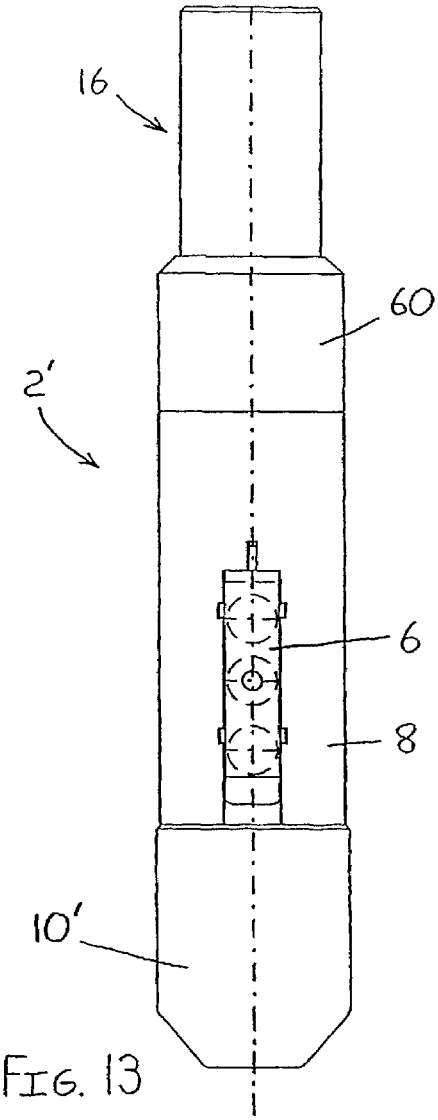
FIG. 13 is a plan view of the second embodiment arranged as shown in FIG. 12.
Figure 14:
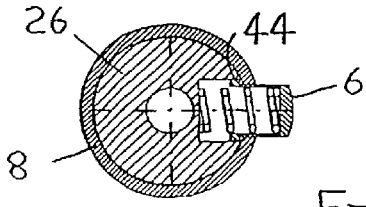
FIG. 14 is a cross-sectional end view taken along line D-D shown in FIG. 12.

The portion of elongate cylindrical member 8 located below the lower internal shoulder 24 is provided with a longitudinally extending elongate slot 28 through which, in use, the window engaging member 6 projects. The slot 28 is provided through the full thickness of the cylindrical member 8 and extends longitudinally so as to provide an opening 30 in the downhole end of said member. The opening 30 assists with assembly of the window finder 2 by allowing the cylindrical piston 26 and window engaging member 6 to be together slid into the bore 20 and elongate slot 28 of the cylindrical member 8. With reference to FIGS. 2 and 6, it will be seen that the edge of the elongate slot 28 is provided with two longitudinally spaced pairs of guide slots 32. The two guide slots 32 of each pair are provided opposite one another on the longitudinally extending edges of the elongate slot 28. The guide slots 32 themselves extend laterally and, when in use, provide a guide for the lateral movement of the window engaging member 6 as said member 6 moves between retracted and extended positions (see FIG. 2 in particular).

The cylindrical piston 26 is provided with a bore 34 longitudinally extending therethrough. An uphole facing external shoulder 36 is provided adjacent an uphole end of the cylindrical piston 26 for abutment with the lower internal shoulder 24 of the cylindrical member 8. The dimensions of the cylindrical piston 26 are such that the outer diameter of the portion of piston 26 located downhole of the external shoulder 26 slidably engages with the inner diameter of the portion of cylindrical member 8 located downhole of the lower internal shoulder 24. Furthermore, the outer diameter of the portion of cylindrical piston 26 located uphole of the external shoulder 36 slidably engages with the inner diameter of the portion of cylindrical member 8 located between the upper and lower internal shoulders 22, 24. One side of the cylindrical piston 26 is provided with a longitudinally extending elongate recess 38 for slidably receiving the window engaging member 6. The relative dimensions of the recess 38 and engaging member 6 are such that the engaging member 6 cannot move uphole, downhole, side to side or twist within the recess 38. Nevertheless, the arrangement is such that the engaging member 6 can readily slide laterally in and out of the recess 38. Furthermore, the depth of the recess 38 is such that, in the assembled window finder 2, the engaging member 6 may be pressed into the recess 38 so as not to project beyond the external diameter of the cylindrical member 8.

A circumferentially extending groove 40 is provided on the exterior of the downhole portion of the piston 26. With the piston 26 and engaging member 6 assembled within the cylindrical member 8, the retaining nut 10 is screwthreadedly engaged with the downhole end of the cylindrical member 8 so as to close the opening 30 and thereby limit downhole axial movement of the piston 26. The initial position of the piston 26 within the cylindrical member 8 is fixed by virtue of a shear pin 42 which is screwthreadedly engaged with the retaining nut 10 and extends into the circumferential groove 40 (see FIG. 1).

Figure 4:
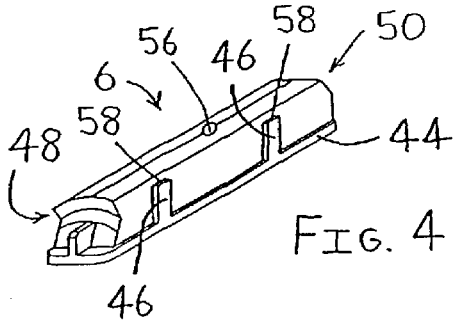
FIG. 4 is a perspective view of an engaging member of the first embodiment.
Figure 5:
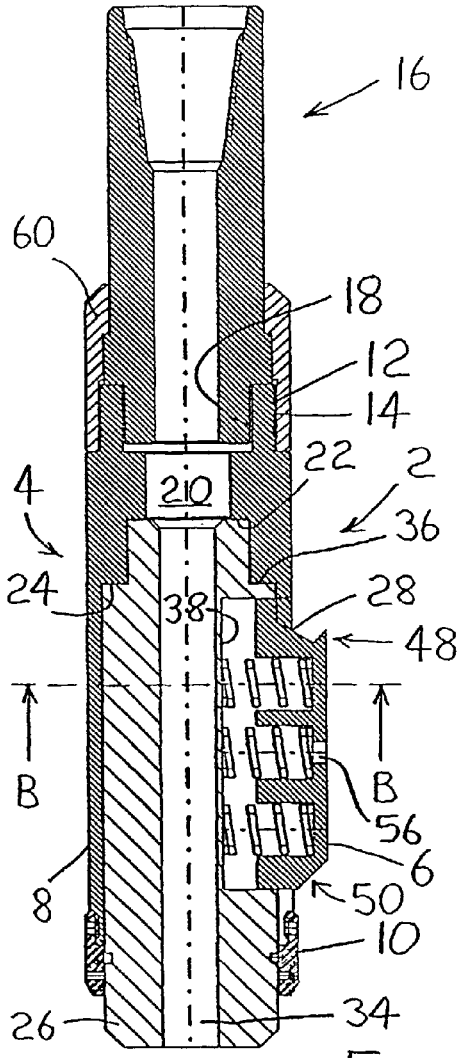
FIG. 5 is a cross-sectional side view of the first embodiment of the present invention arranged in an extended configuration.

A perspective view of the window engaging member 6 is shown in FIG. 4 of the accompanying drawings. The engaging member 6 is provided with a base portion 44 and two pairs of guide rails 46 (only one guide rail of each pair is shown in FIG. 4) for slidably engaging the elongate recess 38. The guide rails 46 are dimensioned and spaced relative to one another so as to be receivable within the guide slots 32. An uphole end of the engaging member 6 is provided with a hook portion 48 for locating about a well bore window when in use. In contrast, a downhole end of the engaging member 6 is provided with a camming portion 50 for cammingly engaging a well bore window when in use. Three cylindrical recesses 52 are longitudinally spaced from one another in the base portion 44 (see FIGS. 1 and 2). Each cylindrical recess 52 receives a compression spring 54 which, in the assembled window finder 2, presses against the recess 38 so as to bias the engaging member 6 towards the extended position. So as to equalize the fluid pressure external to the window finder 2 with that between the engaging member 6 and piston 26, and thereby assist the lateral movement of the engaging member 6, the engaging member 6 is provided with a vent port 56. The vent port 56 provides fluid communication between the exterior of the window finder 2 and the middle cylindrical recess 52.

The vent port 56 may also assist with assembly of the window finder 2 by combining with a threaded rod and providing means for manually retracting the engaging member 6 and clamping said member 6 in the retracted position. The threaded rod (not shown) may be inserted into the vent port 56 and threadedly secured in a threaded recess (not shown) provided in the base of the elongate recess 38 of the piston 26. A nut (not shown) may then be threadedly engaged with a portion of rod extending outwardly from the vent port 56. The nut may be screwed down over the rod towards the piston 26 and, in so doing, abut the outer surface of the engaging member 6 and press the engaging member 6 into the retracted position. With the engaging member 6 clamped in the retracted position against the bias of the compression springs 54, the piston 26 and engaging member 6 may be pushed into the cylindrical member 8. The rod and nut may then be removed.

When the cylindrical piston 26 is fixed relative to the cylindrical member 8 by means of the shear pin 42, the arrangement of the elongate slot 28 and guide slots 32 of the cylindrical member 8 relative to the engaging member 6 is such that the guide rails 46 locate downhole of the associated guide slots 32. Outer ends 58 (see FIG. 4) of the guide rails 46 abut the inner diameter of the cylindrical member 8 and thereby retain the window engaging member 6 in the retracted position against the bias of the three compression springs 54. In this configuration, the window finder 2 may be run in hole without significant risk of the engaging member 6 deploying to the extended position prematurely. When deployment of the engaging member 6 is required, the shear pin 42 is sheared and the cylindrical piston 26 is moved uphole within the cylindrical member 8. This relative movement is limited by the abutment of the external shoulder 36 with the lower internal shoulder 24 and the uphole end of the piston 26 with the upper internal shoulder 22. Any downhole movement of the piston 26 relative to the cylindrical member 8 is limited by abutment of the window engaging member 6 with the retaining nut 10. As the piston 26 moves uphole into abutment with the body 4 (see FIGS. 5 and 6), the guide rails 46 move into alignment with the guide slots 32. The biasing force of the springs 54 is then no longer resisted and the engaging member 6 is pressed into the extended position. This movement to the extended position is guided by the sliding movement of the guide rails 46 within the guide slot 32. In the extended position, the engaging member 6 may project into a well bore window and allows the depth and orientation of said window to be determined. This process will be described in more detail below.

The window finder 2 is connected to a conveying string by means of a connecting sub 16. A precise angular orientation of the window finder 2 relative to the conveying string may be achieved by means of the splines 18. With the window finder and connecting sub splines 18 engaged in the desired orientation, the window finder 2 and connecting sub 16 are releasably secured to one another by means of a connecting collar 60. The connecting collar 60 has internal screwthreads which engage the external screwthreads 14 and thereby, through the interaction of mating shoulders 62 on the connecting collar 60 and connecting sub 16, rigidly secure the connecting sub 16 and window finder 2 together.

As previously mentioned, the first window finder 2 is set mechanically. In other words, the piston 26 is moved from its initial position, wherein the shear pin 42 is located in the circumferential groove 40, to its uphole position, wherein the guide rails 46 are aligned with the guide slots 32, by forcing the piston 26 uphole within the body 4 with mechanical means. This may involve locating the downhole portion of the piston 26 at the end of a well bore or on a well bore plug and allowing the weight of the conveying string to shear the shear pin 42 and press the body 4 downhole whilst the piston 26 remains stationery. However, in an alternative embodiment (as shown in FIGS. 8-14), a second window finder 2' is hydraulically set.

The second window finder 2' is essentially a modified version of the first window finder 2. The majority of the second window finder 2' is identical to the first window finder 2 and like components have been labelled in the accompanying drawings with like reference numerals. The construction and operation of these like components will not be further described. However, with regard to the modifications, it will be seen that an alternative retaining nut 10' is provided as a cap, together with an appropriate O-ring seal 62, for sealing the downhole ends of the cylindrical member and cylindrical piston bores 20, 34. In this way, the interior of the window finder 2' may be pressurised. In order to ensure hydraulic integrity, a further O-ring seal 64 is provided on the piston 26 uphole of the external shoulder 36 for sliding engagement with the cylindrical surface of the piston 26 located between the upper and lower internal shoulders 22, 24. Also, for the purpose of ensuring hydraulic integrity, a modified connecting sub 16 is used which has a cylindrical portion 66 extending from the downhole end thereof into the uphole portion of the bore 20 of the elongate cylindrical member 8. The exterior surface of this cylindrical portion 66 is provided with a yet further O-ring seal 68 for engagement with the elongate cylindrical member 8. An appropriate hydraulic seal between the connecting sub 16 and the second window finder 2' is thereby provided.

In use of the second window finder 2', rather than "bumping down" the window finder on the piston 26 so as to mechanically move the piston 26 from its initial position, hydraulic fluid within the second window finder 2' may be pressurised and, as a consequence of the piston 26 geometry, used to generate an uphole fluid force on the piston 26 sufficient to shear the shear pin 42 and move the piston 26 uphole for deployment of the window engaging member 6. With the guide rails 46 aligned with the guide slots 32, the window engaging member 6 moves laterally to the extended position under the bias of the compression springs 54. This lateral movement of the engaging member 6 is limited by the abutment of the base portion 44 against the cylindrical member 8 (see FIG. 14 in particular).

In use, the first and second window finders 2, 2' assist in determining the depth and orientation of a well bore window. The window engaging member 6 is deployed to the extended position so as to project into the well bore window under survey. The engaging member 6 may be released from the retracted position whilst downhole (e.g. when in the vicinity of the window), or the window finding apparatus may be run in hole with the engaging member 6 deployed to the extended position from the start. Location of the engaging member 6 within the window may be verified by pulling the window finder uphole. In so doing, the window engaging member 6 moves uphole within the window and tends to abut the inwardly curving window edges. Thus, as the engaging member 6 is pulled along the curving window edge towards the uphole end of the window, the window finder and associated string is rotated within the well bore so as to locate centrally on the window longitudinal axis. Once the engaging member 6 reaches the uphole end of the window, the window finder will have been rotated sufficiently to assume a window central orientation. In this position, the hook portion 48 of the engaging member 6 locates about the uphole portion of the window and prevents further uphole movement of the window finder and associated string. The depth and orientation of the "top dead centre" position of the window is thus identified. If the window is skewed in the well bore, then the "top dead centre" and "bottom dead centre" window positions will be angularly offset relative to one another.

Once the survey of the window has been completed, the window finder may be disengaged from the window by pushing the window finder downhole within window so that the camming portion 50 of the engaging member 6 engages the downhole portion of the window so as to cam the engaging member 6 to the retracted position. The window finder and associated conveying string may then be rotated within the well bore so that the engaging member 6 lies adjacent a portion of the well bore diametrically opposite the window. In this way, the window finder may be pulled uphole past the window without further deployment of the engaging member 6.

Figure 15:
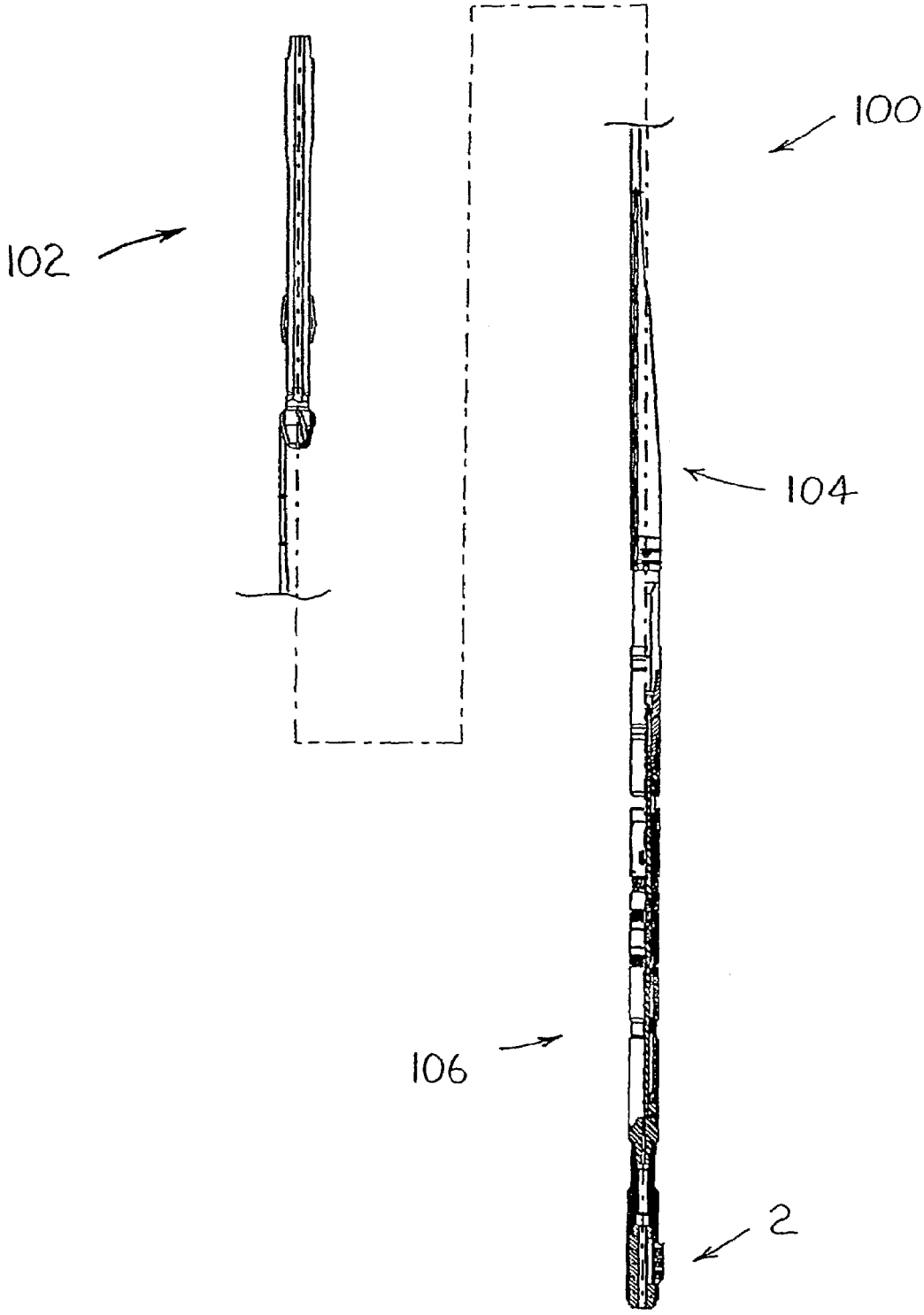
FIG. 15 is a part cross-sectional side view of a single trip whipstock assembly comprising the first embodiment of the present invention.
Figure 16:
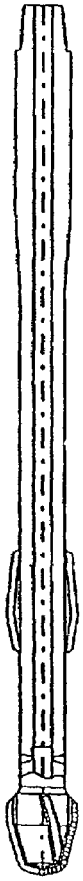
FIG. 16 is an enlarged part cross-sectional side view of a milling tool shown in FIG. 15.
Figure 17:
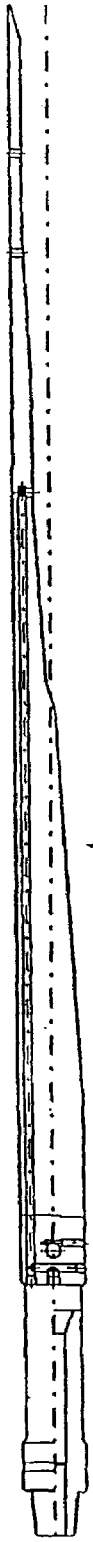
FIG. 17 is an enlarged part cross-sectional side view of a whipstock shown in FIG. 15.
Figure 18:
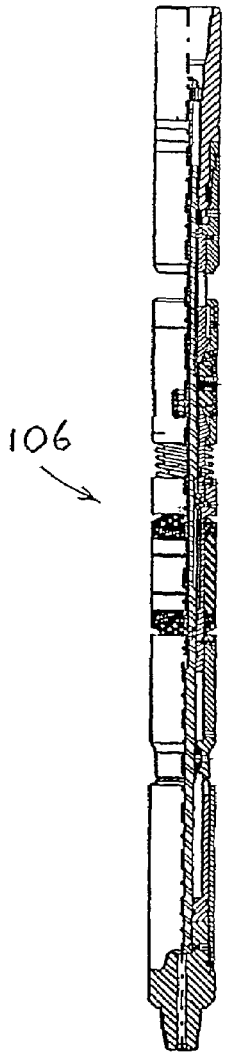
FIG. 18 is an enlarged part cross-sectional side view of an anchor packer shown in FIG. 15.
Figure 19:
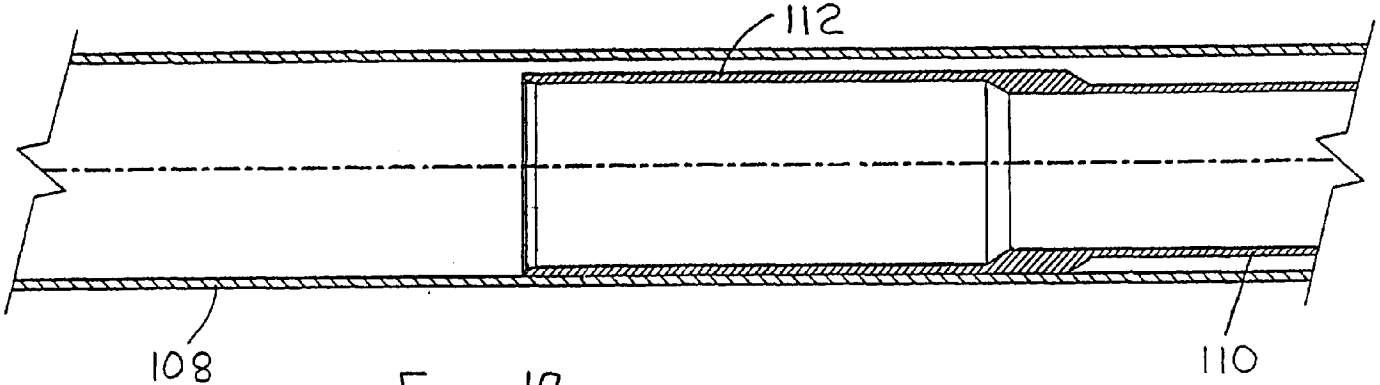
FIGS. 19-29 show a pre-formed window member receiving the first embodiment of the present invention (conveying string not shown)
Figure 20:
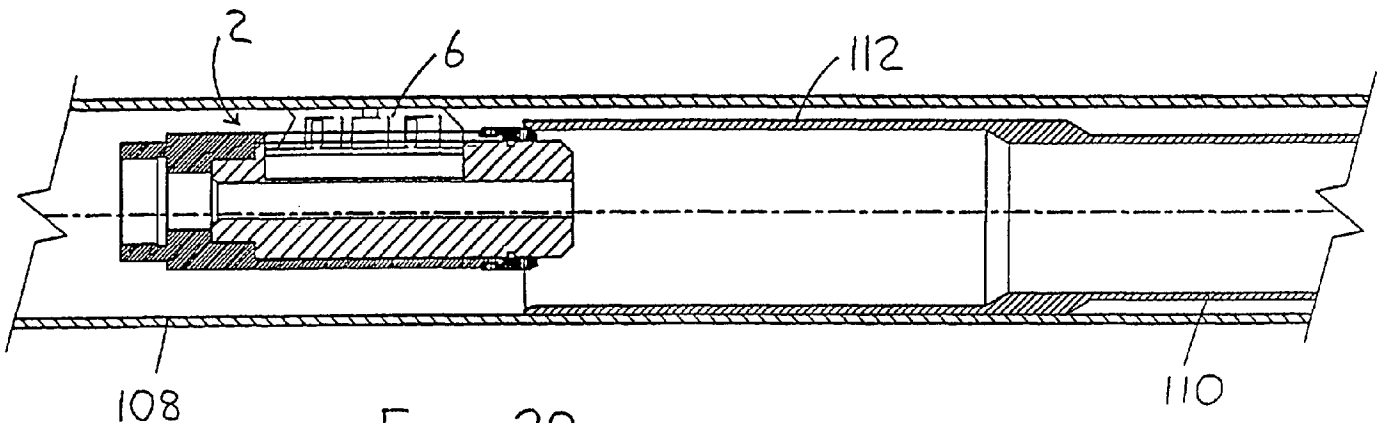
Figure 21:
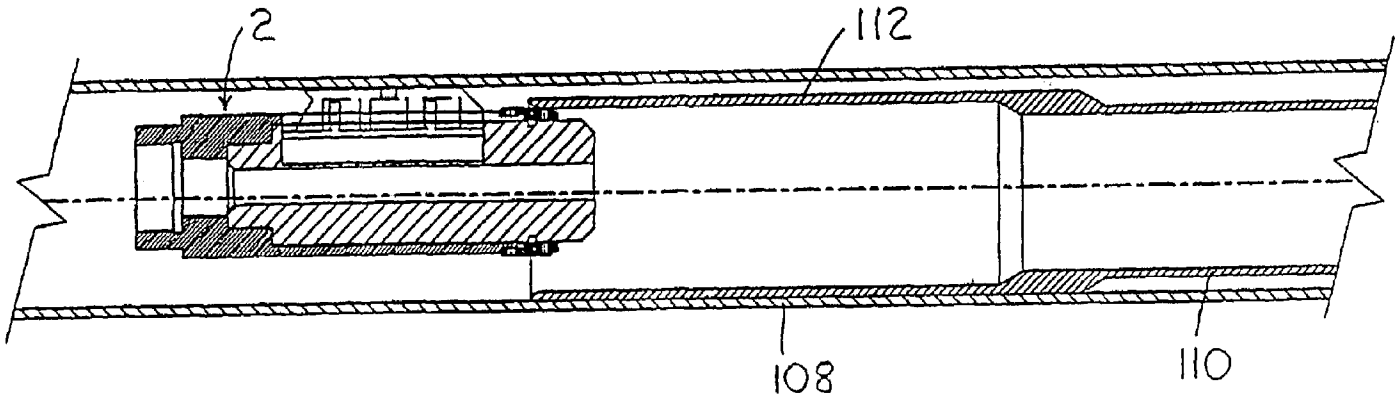
Figure 22:
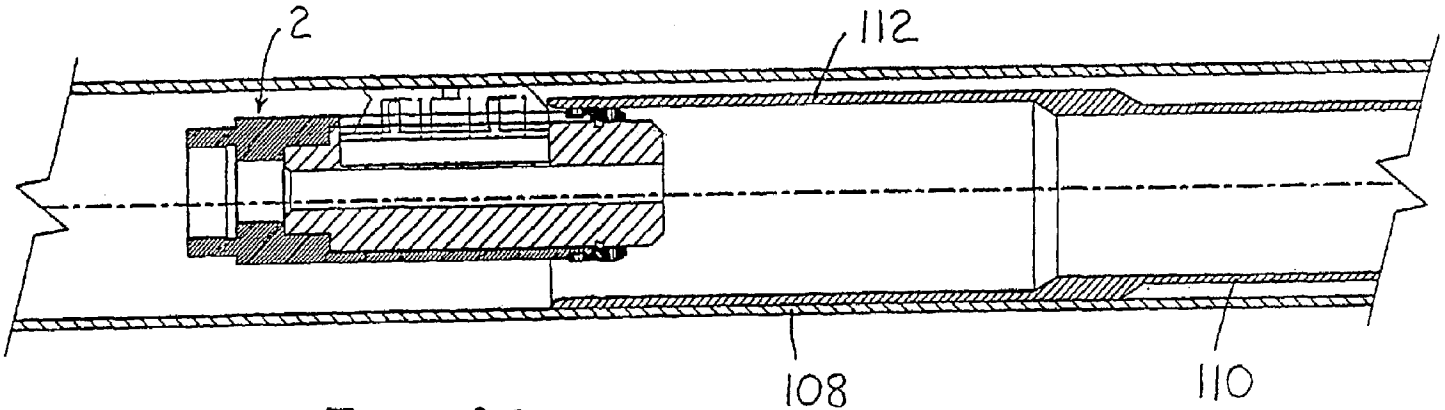
Figure 23:
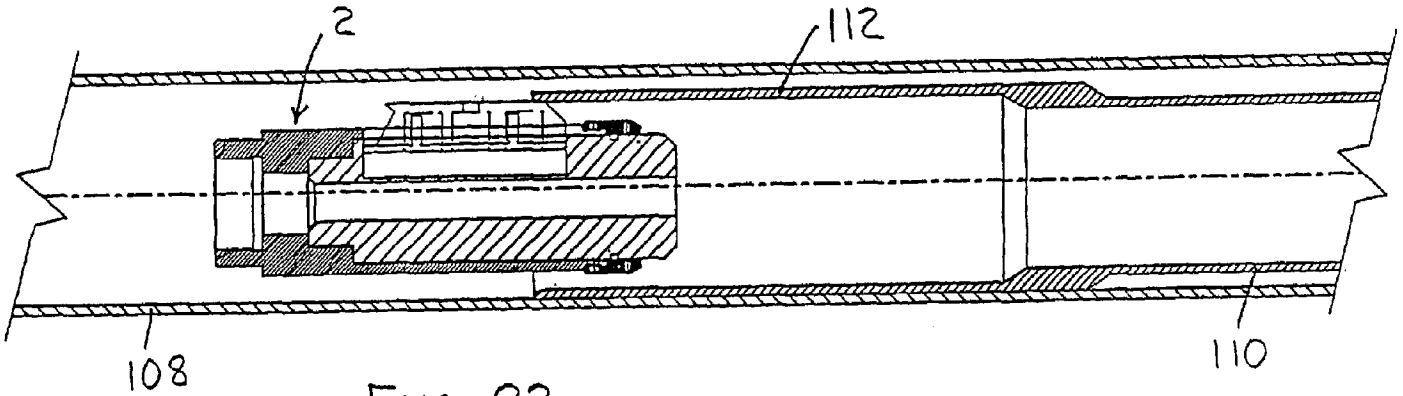
Figure 24:
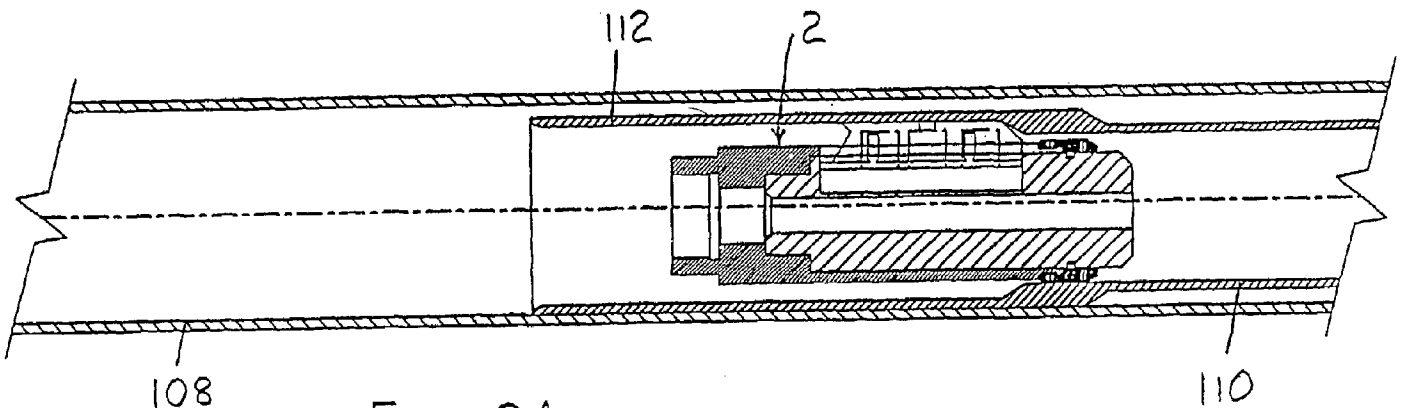

The window finder may be run in hole during a dedicated window survey operation or, alternatively, run in hole as part of a single trip whipstock assembly. By way of illustration, FIG. 15 shows the first window finder 2 connected with a single trip whipstock assembly 100. A milling tool 102, whipstock 104 and anchor packer 106 of the single trip whipstock assembly 100 are shown as enlarged views in FIGS. 16-18 of the accompanying drawings. These are conventional components which will be familiar to the person skilled in the art. In order to accurately record the depth and orientation of the window, it is preferable for the window finder to be used in conjunction with a Measurement While Drilling (MWD) tool or UBHO sub for gyro surveying. As is well understood, such equipment requires a flow of well bore fluid through the associated conveying string in order to provide the required monitoring function. Accordingly, with a view to avoiding an undesirable premature setting of the anchor packer 106, a bypass valve should preferably be provided. The bypass valve will also avoid premature activation of a hydraulically settable window finder. In order to avoid a setting of the anchor packer prior to an activation of the window finder, the packer is selected to have a higher setting pressure than the window finder activation pressure.

Figure 25:
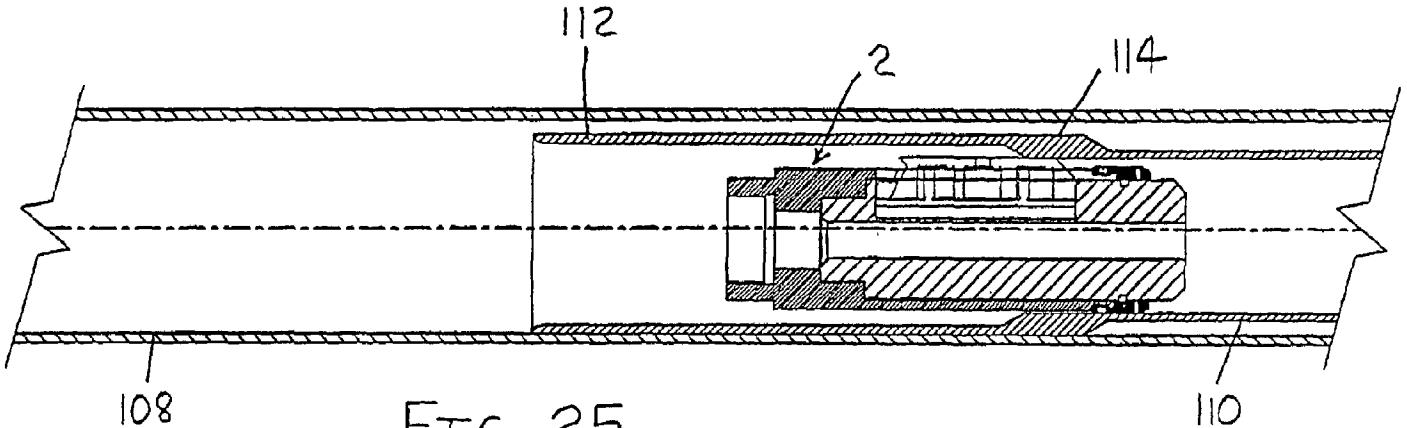
Figure 26:
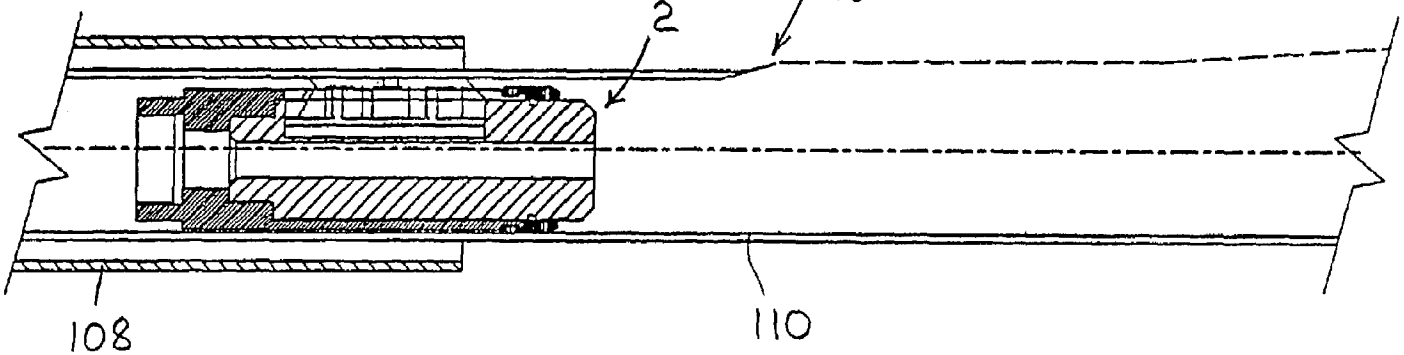
Figure 27:
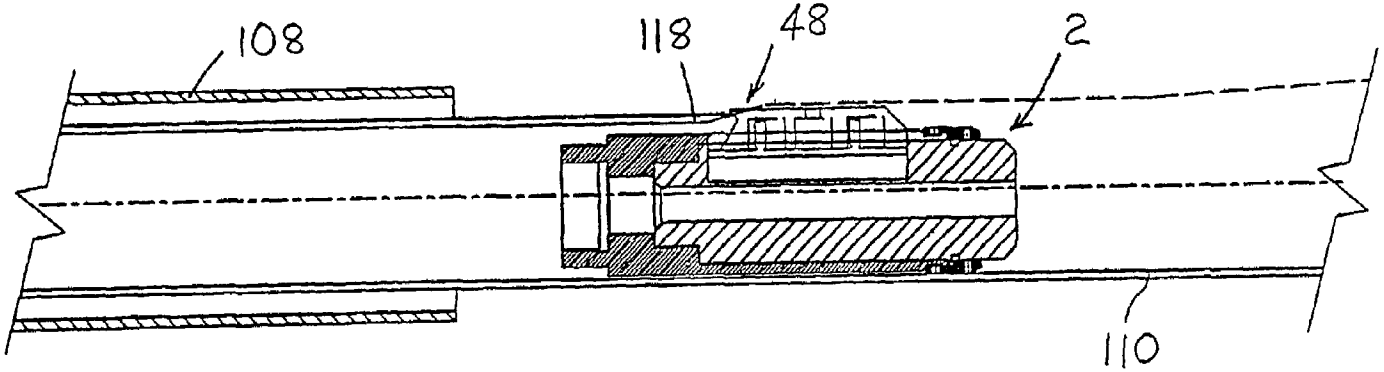
Figure 28:
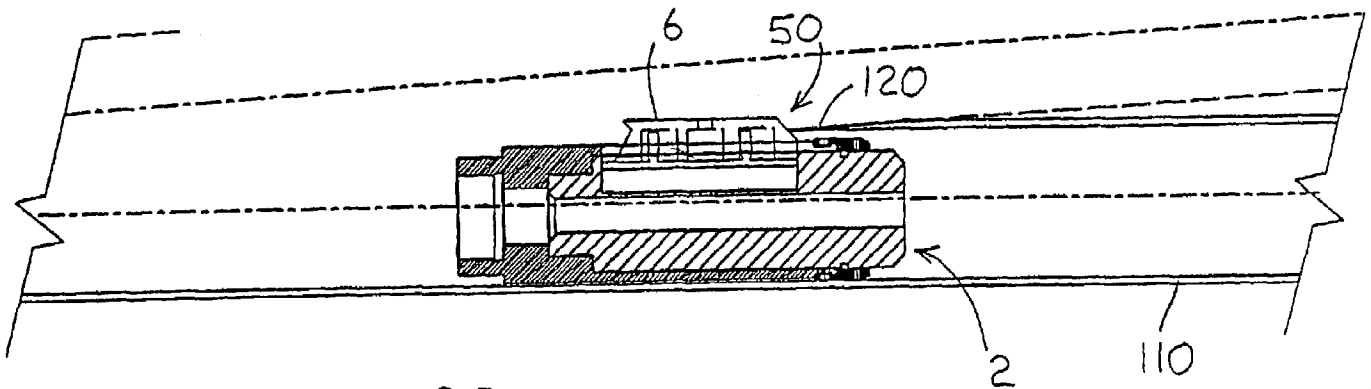
Figure 29:
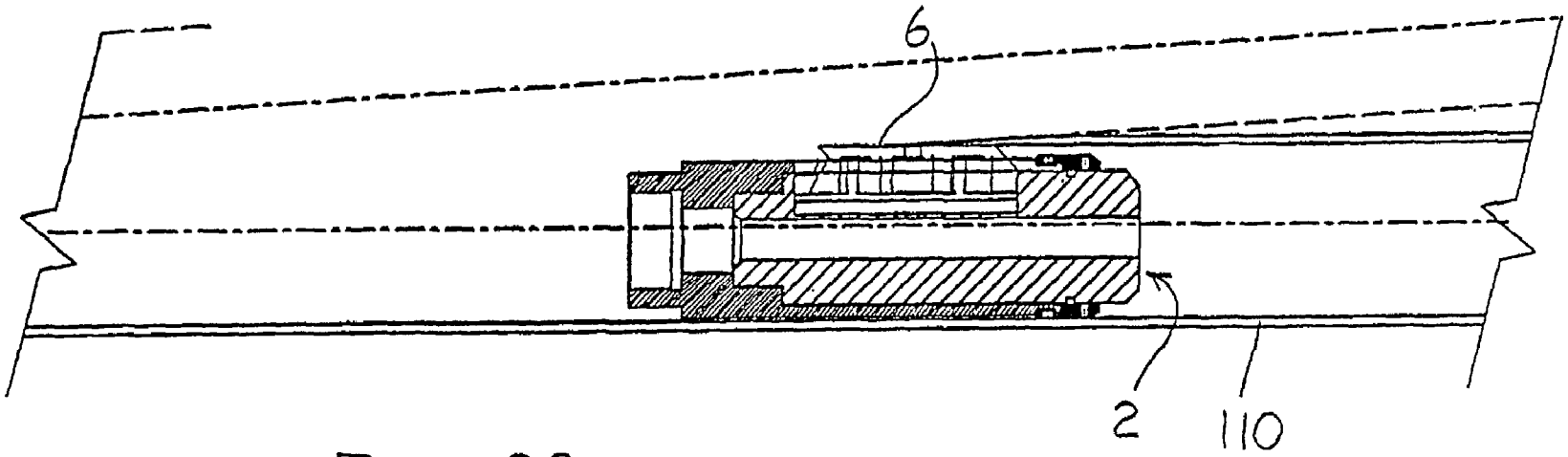

Use of the first window finder 2 in a well bore 108 is shown in FIGS. 19-29 of the accompanying drawings. The well bore 108 is provided with a pre-formed window member 110 (which may have been previously milled whilst in hole) having a Polished Bore Receptacle 112 connected to its uphole end. The window finder 2 is shown in FIGS. 20-24 being received within the Polished Bore Receptacle 112 whilst arranged with the window engaging member 6 deployed in the extended position. If appropriate, the window finder 2 may be run in hole with the engaging member 6 extended. In FIG. 25, it can be seen that, as the window finder 2 is run through the constriction 114 of the Polished Bore Receptacle 112 and into the pre-formed window member 110, the pre-formed window member 110 abuts the camming portion 50 of the engaging member 6 and cams said member 6 to a part-retracted position. Once located adjacent the pre-formed window 116, the window engaging member 6 is free to move to the extended position under the bias of the compression springs 54 as previously described. The window finder 2 is then pulled uphole so as to engage the hook portion 48 with the uphole end 118 of the window 116 (see FIG. 27). In this position, the window finder 2 is centralised in the window 116 so as to provide an indication of the window depth and orientation. The window finder 2 and associated conveying string (not shown in FIGS. 19-29) may then be run further downhole so as to, for example, locate a whipstock adjacent the window 116. In so doing, the downhole end 120 of the window 116 engages the camming portion 50 of the window engaging member 6 and presses said member 6 towards the retracted position. The window finder 2 is thereby able to move past the window 116 (see FIG. 29).

Figure 30:
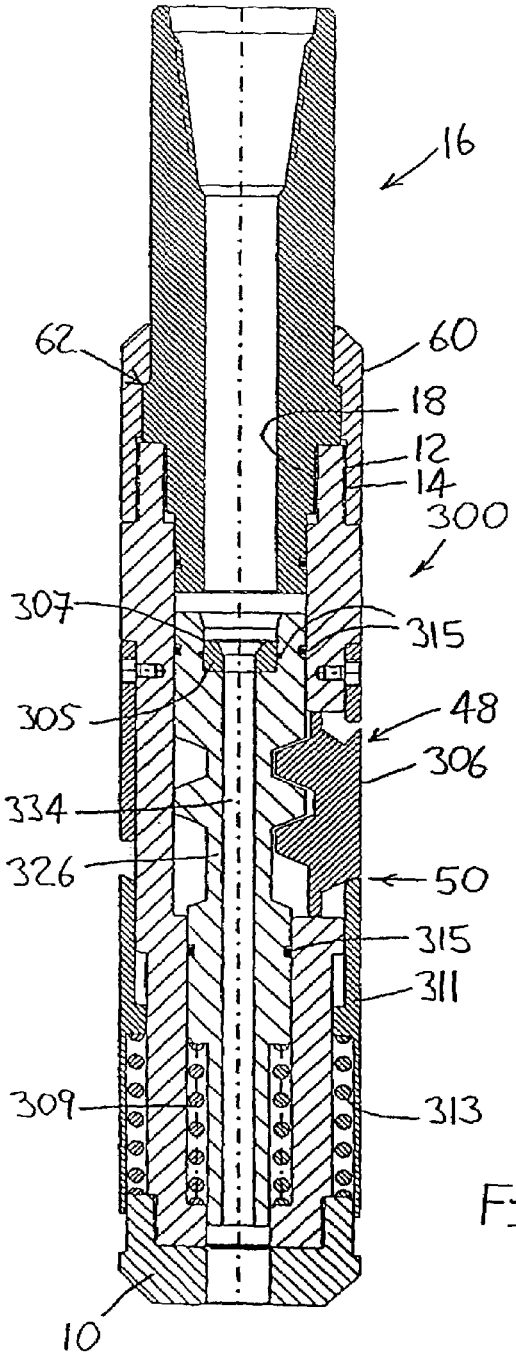
FIG. 30 is a cross-sectional side view of a third embodiment of the present invention arranged in a retracted configuration.
Figure 31:
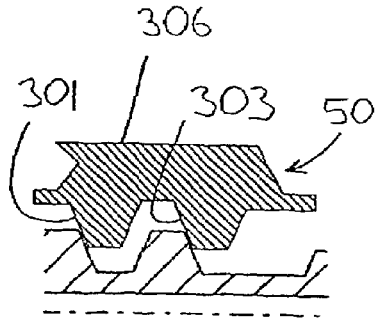
FIG. 31 is a cross-sectional part side view of an engaging member of the third embodiment arranged in an extended position.

The present invention is not limited to the specific embodiments described above. Alternative arrangements will be apparent to a reader skilled in the art. For example, a third window finder 300 is shown in FIG. 30. The third window finder 300 is a modified version of the first window finder 2 and, accordingly, like components are labelled with like reference numerals in the accompanying drawings. The principal modification in the third window finder 300 is the provision of a spring biased cylindrical piston 326 which cammingly engages cam surfaces 301, 303 of the window engaging member 306 (see FIG. 31). In use, a flow of well bore fluid through the window finder 300 passes through an orifice member 305 mounted within the bore 334 of the piston 326. The orifice member 305 is retained in position within the bore 334 by means of a circlip 307. With sufficient fluid flow, the piston 326 is pressed downhole within the window finder 300 against the uphole bias of a compression spring 309. The downhole movement of the piston 326 generates relative movement between the piston 326 and the camming surfaces 301, 303 of the engaging member 306 and causes the engaging member 306 to be cammed laterally into an extended position (see FIG. 31). In moving to the extended position, the window engaging member 306 presses on a cylindrical sleeve 311 mounted around the lower part of the window finder 300. The cylindrical sleeve 311 is biased in an uphole direction into abutment with the camming portion 50 of the engaging member 6 by means of a second compression string 313. As the engaging member 306 moves towards the extended position, the sleeve 311 is cammed downhole by the camming portion 50 against the bias of the compression spring 313. Accordingly, when the rate of flow of well bore fluid through the third window finder 300 is reduced so as to allow the first compression spring 309 to return the piston 326 to its uphole position, the second compression spring 313 tends to press the sleeve 311 against the camming portion 50 so as to cam the engaging member 306 towards the retracted position. In order to ensure hydraulic integrity during operation of the third window finder 300, appropriate O-ring seals 315 are provided on the piston 326.

Figure 32:
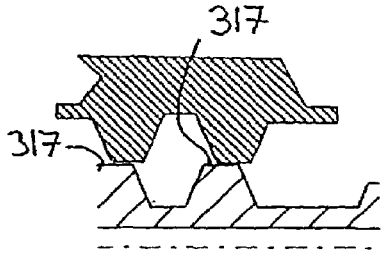
FIG. 32 is a cross-sectional part side view of an engaging member of a modified version of the third embodiment of the present invention.

In a modified version of the third window finder 300, the piston 326 and window engaging member 306 are arranged so that, when in the extended position, the engaging member 306 is supported by surfaces 317 of the piston 326 lying perpendicular to the lateral direction of engaging member 6 travel (see FIG. 32).

Figure 33:
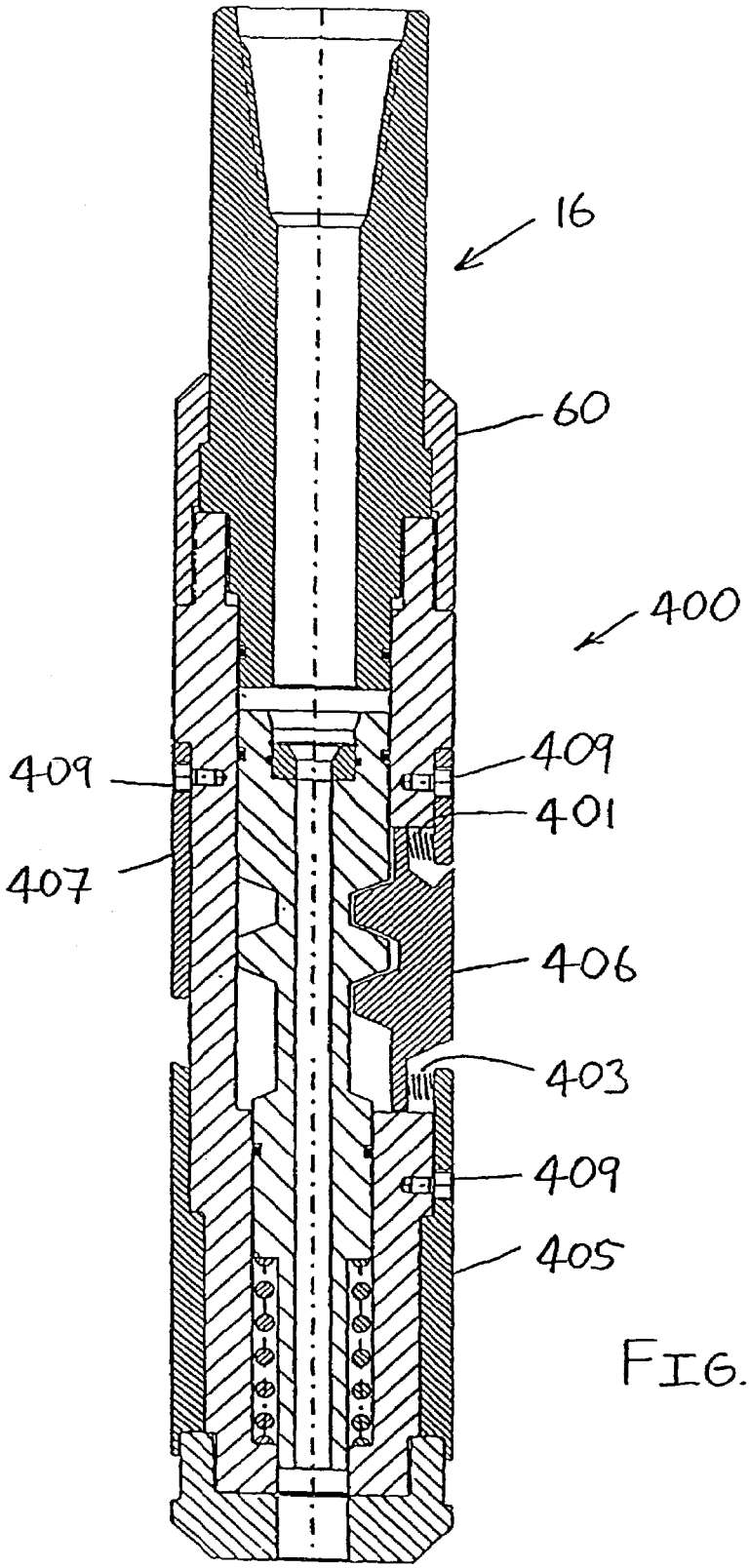
FIG. 33 is a cross-sectional side view of a fourth embodiment of the present invention arranged in a retracted configuration.

A fourth window finder 400 is shown in FIG. 33 of the accompanying drawings. The fourth window finder 400 is essentially identical to the third window finder 300 shown in FIG. 30, principally differing only in the way in which the window engaging member 406 is biased towards the retracted position. Rather than employing an uphole spring biased sleeve, the fourth window finder 400 uses two compression springs 401, 403 located between the ends of the engaging member 406 and two adjacently located outer cylindrical sleeves 405, 407. The outer sleeves 405, 407 are secured in position by means of suitable fasteners (for example, bolts 409).

Figure 34:
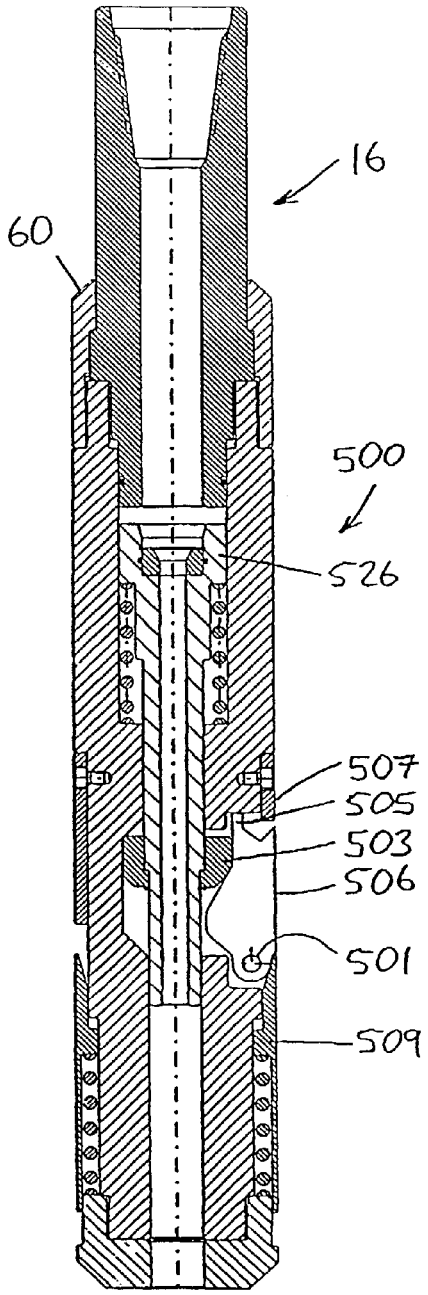
FIG. 34 is a cross-sectional side view of a fifth embodiment of the present invention arranged in a retracted configuration.
Figure 35:
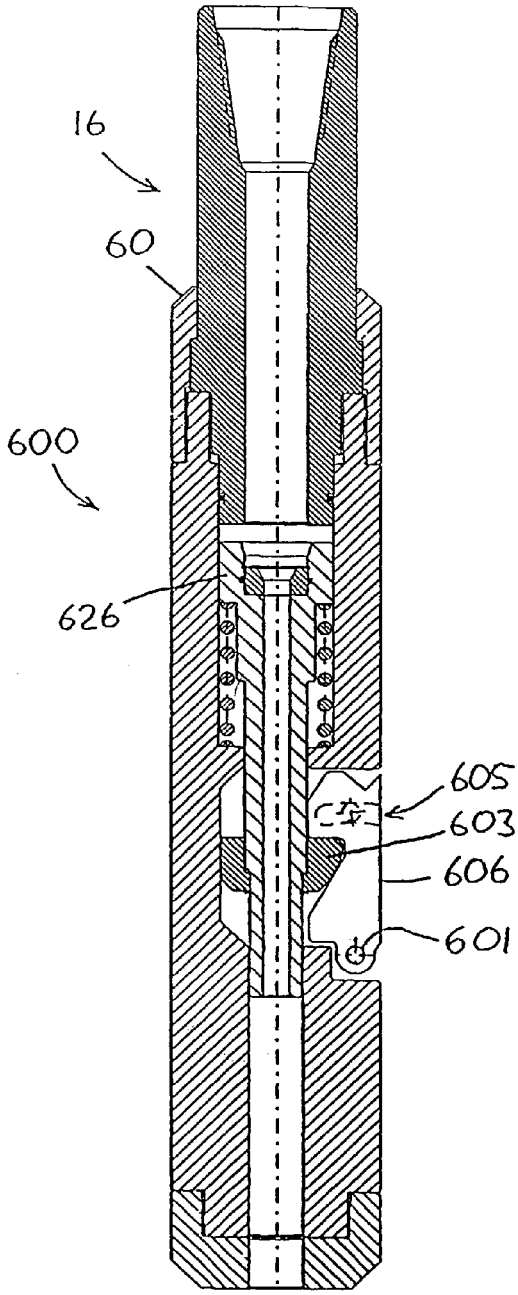
FIG. 35 is a cross-sectional side view of a sixth embodiment of the present invention arranged in a retracted configuration.

Yet further modifications of the third window finder 300 are shown in FIGS. 34 and 35 of the accompanying drawings. In each modified window finder 500, 600, the window engaging member is pivotally mounted so as to rotate between retracted and extended positions. In each case, the window engaging member 506, 606 is mounted at its downhole end by means of a pivot 501, 601. Again, in each case, rotation of the engaging member 506, 606 to the extended position is achieved by pumping well bore fluid through the window finder 500, 600 so as to displace the piston 526, 626 downhole and thereby cause camming members 503, 603 mounted on the piston 526, 626 to press the engaging member 506, 606 laterally outwards. In the case of the fifth window finder 500, rotation of the engaging member 506 to the extended position is limited by means of a stop element 505 of the engaging member 506 abutting an external sleeve 507. As with the fourth window finder 400, the engaging member 506 of the fifth window finder 500 is biased towards the retracted position by means of a spring biased external cylindrical sleeve 509. In the case of the sixth window finder 600, the outward rotation of the engaging member 606 to the extended position is limited by means of a pin and groove arrangement 605, wherein a pin is mounted to either the window finder body or the engaging member 606 and is received within a groove provided in the other of the window finder body and engaging member 606. As well as camming the engaging member 606 laterally outwards, the camming member 603 cooperates with the engaging member 606 so as to cam the engaging member 606 towards the retracted position as the piston 626 is moved uphole.

Yet further alternatives will be apparent to the skilled reader. For example, the window engaging member may be inverted so that the hook portion 48 faces downhole so as to be engageable with a downhole end of a window. In this way, a window finder may be provided for engaging with the downhole end of a window rather than the uphole end of a window as hereinbefore described.

The invention claimed is:

1. A method of locating a deflecting tool at a required position relative to a window formed in a casing of a well, the method comprising: running into the casing an assembly of the deflecting tool and, located below the deflecting tool and rotationally fast therewith, a window finding device having a body and a window engaging member mounted in the body so as to be movable between a retracted position and an extended position, the window engaging member projecting a greater distance from the body when in the extended position than when in the retracted position, and being adapted to project into the window when in the extended position; positioning the assembly so that the window engaging member projects into the window; raising the assembly so that the window engaging member slides along a casing edge defining the window to locate the window engaging member centrally in the window at an upper end thereof and thereby locating the deflecting tool at a known orientation and depth relative to the window; and subsequently lowering the assembly a pre-determined distance to position the deflecting tool at the required position relative to the window.

2. A method according to claim 1, including an additional step of setting an anchor which forms part of the assembly after actuation of the window finding device.

3. A method according to claim 1, wherein the deflecting tool is a whipstock.

4. A method according to claim 2, wherein the deflecting tool is a whipstock.

5. A method according to claim 3, wherein the assembly is a single trip whipstock assembly.

6. A downhole tool assembly comprising a deflector tool having an uphole end and a downhole end, and a window finder located below the downhole end of the deflector tool, the window finder being rotationally affixed with the deflector tool and having a body and a window engaging member mounted in the body so as to be movable between a retracted position and an extended position, the window engaging member projecting a greater distance from the body when in the extended position than when in the retracted position, and being adapted to project into a window formed in a well casing in which the assembly is located to engage an upper end of the window upon upward movement of the deflector tool to orient the deflector relative to the window, the window engaging member being retractable from its extended position to allow subsequent passage of the window engaging member to a position below the window so that the deflector tool may be positioned adjacent the window.

7. A downhole tool assembly according to claim 6, wherein the deflector tool is a whipstock.

8. A downhole tool assembly according to claim 7, wherein the assembly is a one trip whipstock assembly.

* * * * *